US005205181A

United States Patent [19]

Wright

[11] Patent Number: 5,205,181

[45] Date of Patent: Apr. 27, 1993

[54] MANUAL MOTION CONTROL OVERRIDE APPARATUS

[75] Inventor: Stephen D. Wright, Knoxville, Iowa

[73] Assignee: Vermeer Manufacturing Company

[21] Appl. No.: 830,708

[22] Filed: Feb. 3, 1992

[51] Int. Cl.[5] ..... G05G 11/00

[52] U.S. Cl. ..... 74/480 R; 74/481; 180/323

[58] Field of Search ..... 74/479, 480 R, 481; 180/321, 323

[56] References Cited

U.S. PATENT DOCUMENTS 3,898,891 8/1975 Colloton ..... 74/481 X
4,119,000 10/1978 Venable ..... 74/479
4,156,370 5/1979 Callaghan ..... 74/481
4,346,617 8/1982 Schroeder et al. ..... 74/481
4,369,856 1/1983 Nudd ..... 180/321

*Primary Examiner*—Richard M. Lorence
*Attorney, Agent, or Firm*—Kent A. Herink; Brian J. Laurenzo

[57] ABSTRACT

An override control system for a ground-supported machine. A hand lever is used to adjust the equilibrium position of a self-centering device which is interconnected to a drive system of the machine so that a principal ground speed of the machine is selected and set by adjustment of the hand lever. A second control lever is connected to the drive system through the self-centering device and is operable to adjust the speed and direction of motion of the machine away from that set by the hand lever. Upon release of the second control lever, the self-centering device returns the ground speed of the machine to the preselected principal value.

16 Claims, 3 Drawing Sheets

MANUAL MOTION CONTROL OVERRIDE APPARATUS

BACKGROUND OF THE INVENTION

The invention relates generally to motion control systems and, more particularly, to a manual motion control override system which allows an operator of a machine to override and alter a preselected control setting of the machine.

A variety of machines include a plurality of control systems for controlling the motion of the machine. For example, tractors frequently have a hand throttle which is used to set a preselected operating speed of the tractor and a foot-actuated accelerator pedal which is biased to an idle position and depressed by the foot of an operator to control the speed of the tractor. Particularly of interest are machines which include an attachment for the creation of ground trenches and which may also include a remote operator station from which control of the motion of the machine is desired.

When such machines are used to create ground trenches, the speed of the engine is set to provide sufficient power to the attachment. A low speed range or creep speed is selected and set. As soil conditions through which the machine is operating change, it may be desired to alter the speed or direction of motion of the machine either from the main operator station or from a remote operator station. It is also desired that return to the preselected operating speed should be simple and quick to accomplish.

SUMMARY OF THE INVENTION

The invention consists of a control system for a ground-operated machine which is operable in a forward and reverse direction over both a high range of speeds generally used for transport of the machine and a low range of speeds generally used for working operation of the machine. A first controller is used to select and maintain a selected ground transport speed for the machine. A self-centering device interconnects a second controller with the driving means whereby said second controller is operable to adjust the ground travel speed of the machine above and below the selected speed and to change the direction of motion of the machine. The self-centering device acts to return the speed of the machine to the selected speed upon release of the second controller. The invention further contemplates a plurality of additional controllers which are interconnected to the driving means through the self-centering device to enable them to operate to override the motion of the machine in the same manner as the second controller.

An object of the present invention is to provide a manual motion control override system which permits manual adjustments to be made to the motion of a ground-traveling machine relative to a preselected ground speed.

Another object of the invention is to provide a manual motion control override apparatus which permits temporary override of a preselected ground speed and direction of motion of the machine and which upon release automatically returns to said preselected speed and direction.

A further object of the invention is to provide a manual motion control override apparatus whereby a preselected ground speed of a machine may be temporarily overridden from a plurality of independently operable controllers.

These and further objects of the invention will be made apparent upon a review of the following specification, attached drawings, and claims.

DETAILED DESCRIPTION OF A PREFERRED EMBODIMENT

Figure 1:
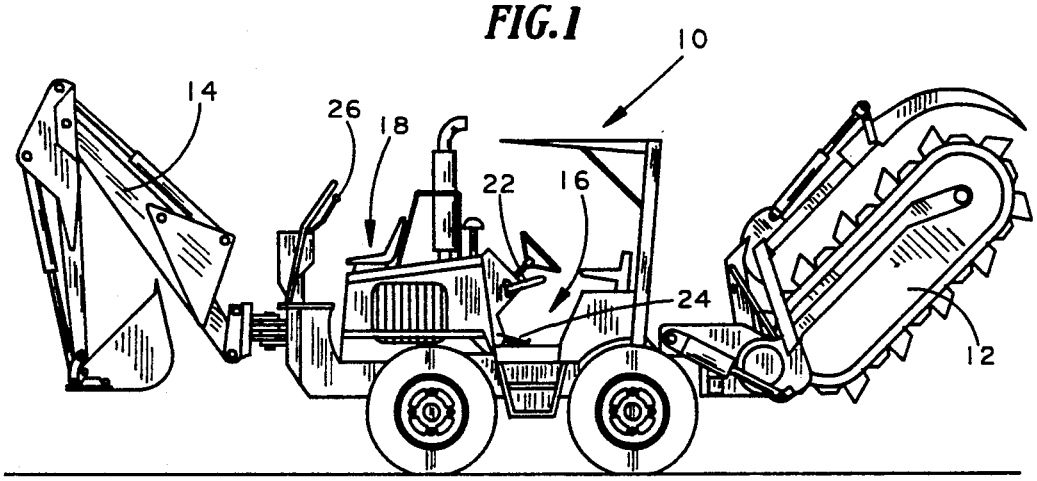
FIG. 1 is a side view of a ground-traveling machine including a rear-supported trenching bar and a forwardly mounted backhoe and which employs the present invention.

Illustrated in FIG. 1, generally at 10, is a ground-supported tractor which includes a rear-mounted trenching bar 12 and a forwardly mounted backhoe 14. The tractor 10 has a main operator station at 16 and a remote operator station at 18. The machine 10 also includes a drive system which in the preferred embodiment is a hydraulic drive system consisting of a hydraulic pump 20 (FIG. 2) which is driven by the main drive engine of the machine 10. The hydraulic drive system is operable over two speed ranges, a first, high speed range and a second, low speed range. The high speed range is used generally for operating the machine 10 in a transport condition between operating sites and wherein neither the trenching bar 12 nor backhoe 14 are in use. In the high speed range, the machine 10 can only be operated from the main operator station 16.

The second, low speed range is generally used for ground travel of the machine 10 when the trenching bar 12 is also being operated to "creep" the machine 10 to advance the trenching bar 12 at an appropriate, low speed for efficient trenching. The machine 10 may be operated throughout the low or creep range of speeds from either the main operator station 16 or the remote operator station 18.

In a typical operation, the primary ground speed of the machine 10 can be set by positioning a hand lever 22 located adjacent the main operator station 16. A motion control foot pedal 24 is also located adjacent the main operator station 16 and can be used as described below to adjust the speed and direction of travel away from the preselected speed set by the hand lever 22. The motion control foot pedal can also be used for primary ground speed and direction of the machine 10. A creep override hand lever 26 is positioned adjacent the remote operator station 18 and can be used in the manner described below to adjust the creep speed and motion of the machine 10 away from that preselected by the hand lever 22. The creep override hand lever 26 can also be used for primary ground speed and direction of the machine 10.

Figure 2:
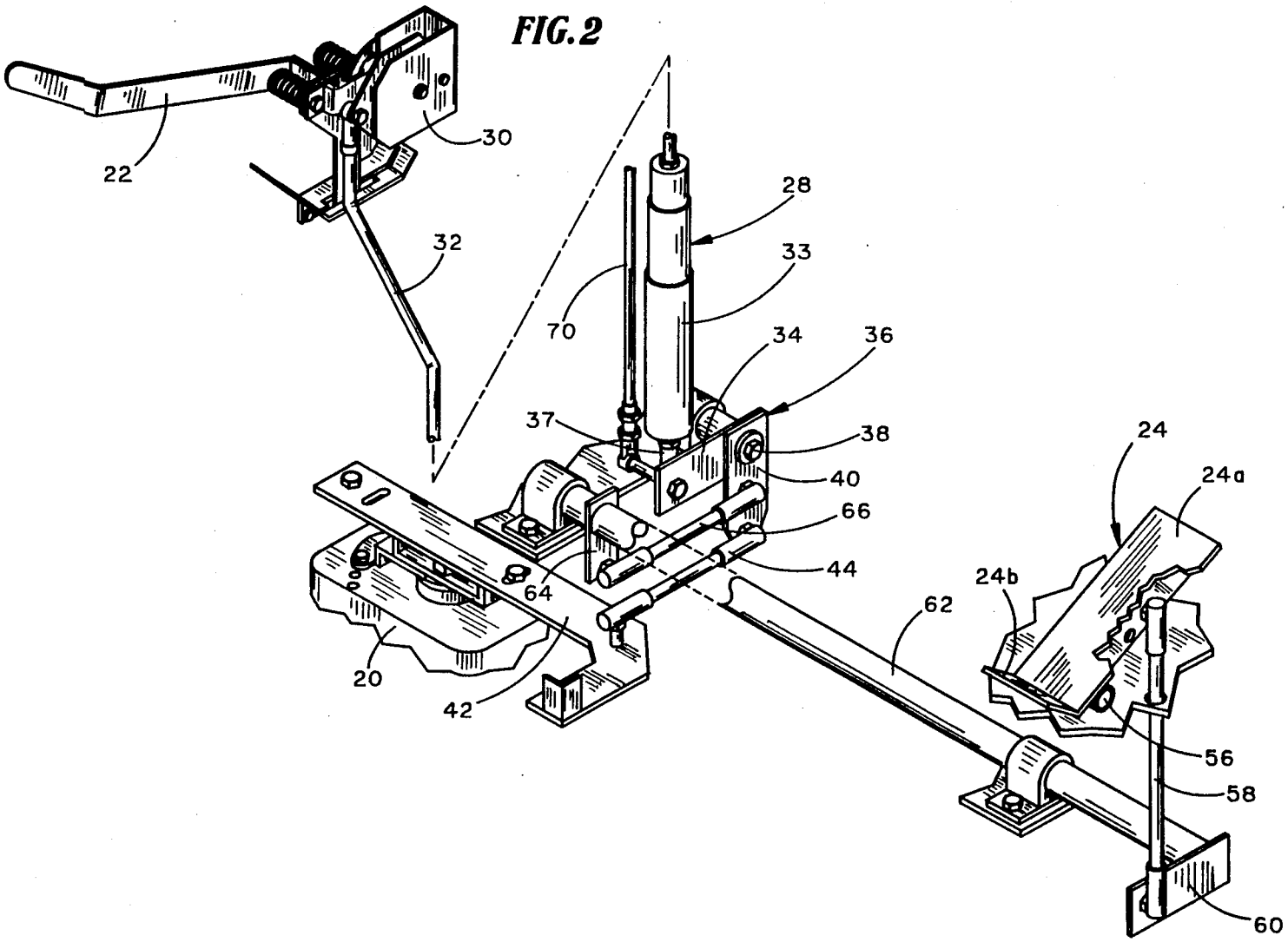
FIG. 2 is an enlarged detail view of a first and second controller and self-centering means for controlling the motion of the machine of FIG. 1.

As best illustrated in FIG. 2, the hand lever 22 is operably interconnected to the hydraulic pump 20 through a self-centering device 28 and a plurality of associated linkages. Movement of the hand lever 22 operates a non-linear controller 30 which in turn pushes (or pulls) on a first connecting rod 32 which, in turn, moves a substantially cylindrical outer casing 33 of the self-centering device 28 downwardly (or upwardly). Regardless of this downward or upward movement, a spring assembly 35 (FIG. 4) moves in conjunction with the movement of the casing 33. A spring assembly rod 37 is pivotally connected to a first leg portion 34 of an L-shaped primary pivot arm 36 that is mounted for pivotal movement about a horizontal axis at 38. A second leg portion 40 of the primary pivot arm 36 is pivotally interconnected to a hydraulic pump control linkage 42 by a connecting link 44. The pump control linkage 42 adjusts the output of the hydraulic pump 20 to hydraulic drive motors of the machine 10 and, accordingly, the ground speed and direction of motion of the machine 10.

Figure 4A:
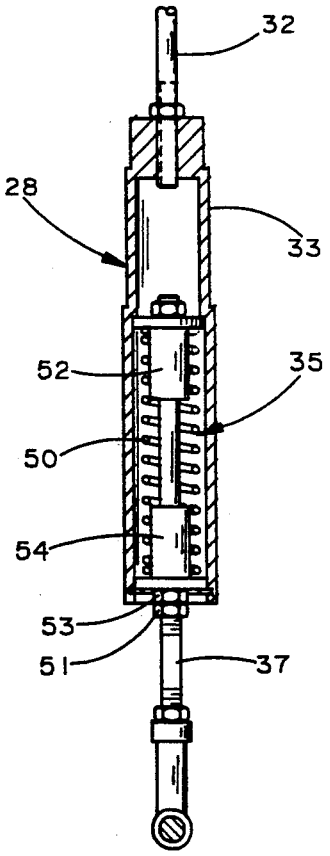
FIGS. 4*a–c* is an enlarged detail cross sectional view of the self-centering device in three different positions.

As best illustrated in FIG. 4*a*, the spring assembly rod 37 is received for relative longitudinal movement inside the outer casing 33 of the self-centering unit 28. A spring 50 is held in compression through the use of two spring glands 52 and 54 at respective ends of spring 50. Two jam nuts 51 and 53 secure the spring 50 and spring glands 52 and 54 to the spring assembly rod 37. Accordingly, the spring 50 acts to urge the spring glands 52 and 54 and the associated spring assembly rod 37 toward an equilibrium position inside the casing 33. Movement of the spring glands 52 and 54 and spring assembly rod 37 away from the equilibrium position can be accomplished only by further compression of the corresponding spring 50.

Referring again to FIG. 2, the pedal 24 is mounted for pivotal movement about a horizontal axis at 56. A vertical connecting rod 58 is pivotally attached at its upper end portion to the pedal 24 and at its lower end portion to an extension ear 60 that is attached to a first end portion of a horizontally extended pivot bar 62. The opposite end portion of the pivot bar 62 is interconnected to the second leg portion 40 of the primary pivot arm 36 by a depending ear 64 and interconnecting link 66. Pivotal movement of the pedal 24 about its axis 56 will result in adjustment of the pump control linkage 42. It will be appreciated, however, that the pedal 24 can be pivoted only by overcoming the resistance of the corresponding spring 50. If an operator pushes on the upper or toe portion 24A of the pedal 24, the interconnecting linkage to the self-centering device 28 will pull down on the rod 37 thereby acting to compress the spring 50 by the downward movement of gland 52. Alternatively, if the lower or heel portion 24B of the pedal 24 is depressed, the pedal 24 will pivot so as to push upwardly on the rod 37 and act to compress the spring 50 by the upward movement of gland 54.

In a typical operation of the machine 10, a desired principal ground speed of the machine 10 is selected by adjustment of the hand lever 22 which, as explained above, will change the position of the outer casing 33 of the self-centering device 28. The glands 52 and 54, in the absence of any exterior forces on the rod 37, will maintain a condition of equilibrium between the spring 50, the spring glands 52 and 54, and the associated spring assembly rod 37 (FIG. 4*a*). The pump control linkage 42 will, accordingly, be pivoted to the position corresponding to the ground speed and direction of motion selected by the hand lever 22. If the operator at the main operator station 16 desires to adjust the preselected ground speed of the machine 10 or alter its direction of motion, the pedal 24 can be depressed in the corresponding direction by the desired amount. The result is that the corresponding gland 52 or 54 and associated rod 37, as well as the pump control linkage 42, will be temporarily adjusted in position as desired, but the position of the outer casing 33 of the self-centering device 28 will remain unchanged. Upon release of the pedal 24, the spring 50 will return the glands 52 and 54 to the equilibrium position which will result in the pump control linkage 42 returning the machine 10 to the preselected speed and direction set by the hand lever 22.

The foot pedal 24 can similarly be used to control spring 50, glands 52 and 54, associated rod 37, and pump control linkage 42 to function in an identical manner, as mentioned above, when the foot pedal 24 is used for primary ground speed and direction, with hand lever 22 in the neutral position (no movement). Upon release of the foot pedal 24, the pump control linkage 42 returns to the neutral position.

Figure 4B:
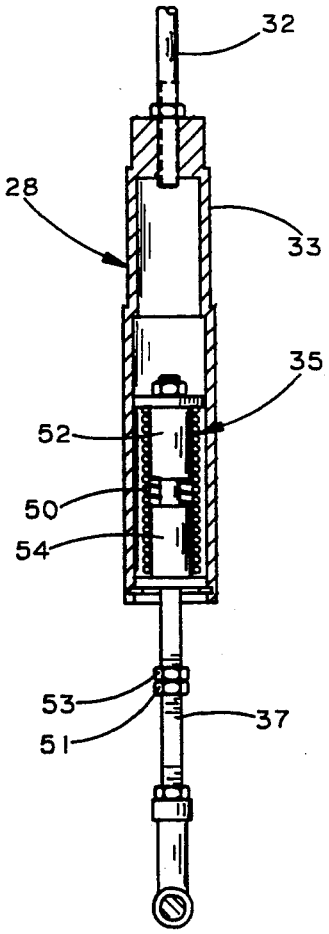
Figure 4C:
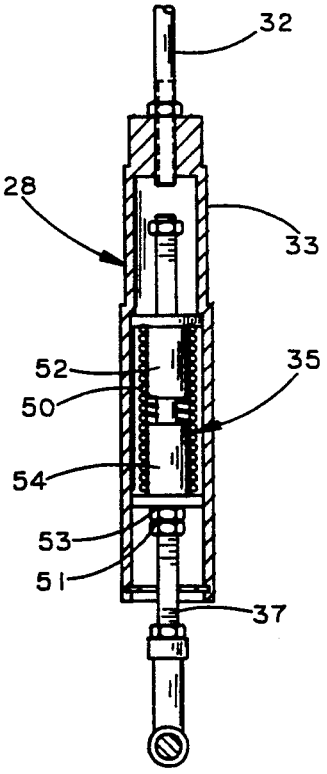
Figure 3:
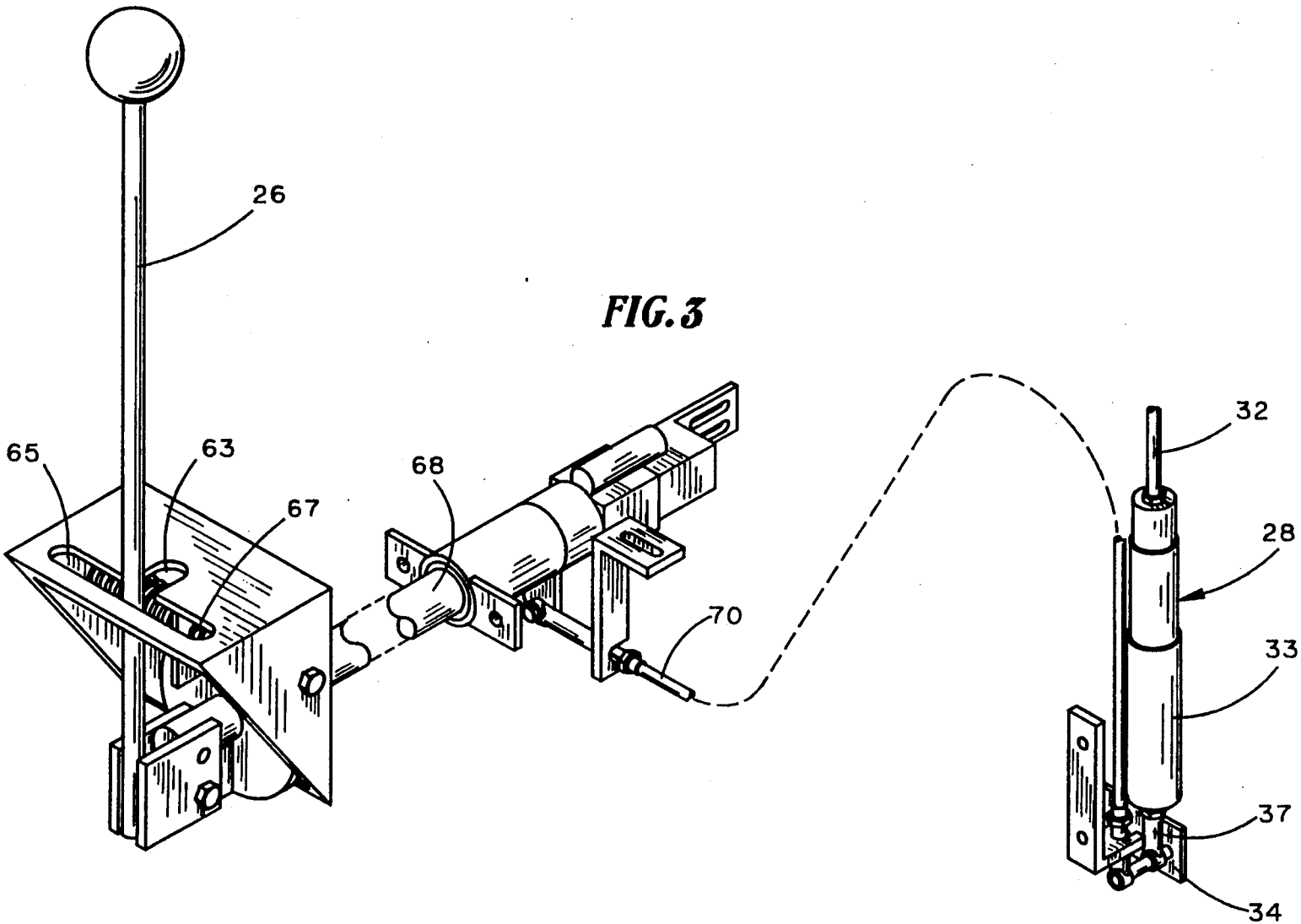
FIG. 3 an enlarged detail perspective view of a third controller operable to control the machine of FIG. 1.

The creep override lever 26 (FIG. 3) can similarly be operated from the remote operator station 18 to override the speed and direction of motion of the machine 10 in the lower range of speeds. The creep override lever 26 is moveable from a central, neutral position 63 towards a first position 65 to increase the creep speed of the machine or towards an opposite second position 67 to decrease the creep speed of the machine 10. Movement of the creep override lever 26 towards either the first or second positions acts to pivot a control bar 68 about its longitudinal axis. A flexible cable 70 interconnects the control bar 68 to the lower end portion of the spring assembly rod 37 of the self-centering device 28. Movement of the creep override lever 26 towards the first position 65 will, accordingly, pull downwardly on the rod 37 and thereby act to compress the spring 50 through downward movement of gland 52 (FIG. 4*b*). Movement of the creep override lever 26 towards the second position 67 will act to push upwardly on the rod 37 and thereby act to compress the spring 50 through upward movement of gland 54 (FIG. 4*c*). As described previously with respect to the pedal 24, the creep override lever 26, accordingly, acts to adjust the speed and direction of the machine 10 either above or below the speed and direction preselected and set by the hand lever 22. Upon release of the creep override lever 26, the spring 50 will act to return it to the neutral position and result in the speed and direction of the machine 10 returning to that preselected and set by the hand lever 22.

The creep override lever 26 can similarly be used to control spring 50, glands 52 and 54, associated rod 37, and pump control linkage 42 to function in an identical manner, as mentioned above, when the creep override lever 26 is used for primary ground speed and direction, while the hand lever 22 is in the neutral position (no movement). Upon release of the creep override lever 26, the pump control linkage 42 returns to the neutral position.

Although the invention has been described with respect to a preferred embodiment thereof, it is to be also understood that it is not to be so limited since changes and modifications can be made therein which are within the full intended scope of this invention as defined by the appended claims.

I claim:

1. An override control system for a ground traveling machine, comprising:

(a) means for driving the machine in a forward and reverse direction over a first, high range of speeds and a second, low range of speeds;

(b) first control means for said high and said low range of speeds operable to select and maintain a selected speed within said speed ranges;

(c) second control means;

(d) self-centering means operably connected to said second control means and said driving means, said second control means being operable to adjust the speed of the machine above and below said selected speed; and (e) said self-centering means operable to return the speed of the machine to said selected speed upon release of said second control means.

2. An override control system as defined in claim 1, wherein said first and second control means are located at a principal operator's station.

3. An override control system as defined in claim 1, further comprising a third control means interconnected to said driving means through said self-centering means and operable to adjust the speed of the machine above and below said selected speed.

4. An override control system as defined in claim 3, wherein said self-centering means is operable to return the speed of the machine to said selected speed upon release of said third control means.

5. An override control system as defined in claim 3, wherein said first control means is located at a principal operator's station and said third control means is located at a remote operator's station.

6. An override control system as defined in claim 3, wherein said first and second control means are located at a principal operator's station and said third control means is located at a remote operator's station.

7. An override control system as defined in claim 1, wherein said first control means includes a hand-operated lever.

8. An override control system as defined in claim 1, wherein said driving means includes a hydraulic pump and said first control means includes a manual non-linear controller for controlling said hydraulic pump.

9. An override control system as defined in claim 1, wherein said second control means is a foot pedal.

10. An override control system as defined in claim 1, wherein said second control means is operable to change the direction of motion of said machine.

11. An override control system as defined in claim 1, further comprising a remote operator's location for access to a trenching control system and wherein said second control system is operable only to adjust the speed of said machine over said second, low range of speeds.

12. An override control system as defined in claim 3, further comprising a remote operator's location for access to an operations control system and wherein said third control system is operable only to adjust the speed of said machine over said second, low range of speeds.

13. An override control system as defined in claim 3, further comprising a principal operator's location for access to an attachment control system and wherein said second control system is operable to adjust the speed and direction of said machine over said first, a high range of speeds and said second, low range of speeds.

14. An override control system as defined in claim 1, wherein said self-centering device includes a spring held under compression between two spring glands inside a cylindrical casing.

15. An override control system as defined in claim 14, wherein said first control means is operable to alter the position of said casing to thereby select and maintain a selected speed within said speed ranges.

16. An override control system as defined in claim 15, wherein said second control means is operable to alter the position of said spring glands to thereby adjust the speed of the machine above and below said selected speed.

* * * * *